US009015908B2

(12) United States Patent
Matsumoto et al.

(10) Patent No.: US 9,015,908 B2
(45) Date of Patent: Apr. 28, 2015

(54) LIQUID-TIGHT SLIDE FASTENER

(75) Inventors: Satoshi Matsumoto, Taipei (TW); Chih Hung Lin, Taipei (TW); Ke Jyun Wu, Taipei (TW)

(73) Assignee: YKK Corporation (JP)

( * ) Notice: Subject to any disclaimer, the term of this patent is extended or adjusted under 35 U.S.C. 154(b) by 119 days.

(21) Appl. No.: 13/512,504

(22) PCT Filed: Nov. 30, 2009

(86) PCT No.: PCT/JP2009/070134

§ 371 (c)(1),
(2), (4) Date: May 29, 2012

(87) PCT Pub. No.: WO2011/064893

PCT Pub. Date: Jun. 3, 2011

(65) Prior Publication Data

US 2012/0246886 A1 Oct. 4, 2012

(51) Int. Cl.
*A44B 19/32* (2006.01)
*A44B 19/08* (2006.01)
(Continued)

(52) U.S. Cl.
CPC ..... *A44B 19/32* (2013.01); *Y10T 24/2539* (2015.01); *Y10T 24/2543* (2015.01); *Y10T 24/2514* (2015.01); *A44B 19/02* (2013.01); *Y10T 24/25* (2015.01)

(58) Field of Classification Search
CPC ..... Y10T 24/2543
USPC ..... 24/389, 392, 415, 384, 403, 405
See application file for complete search history.

(56) References Cited

U.S. PATENT DOCUMENTS 2,296,468 A * 9/1942 Feist ..... 24/384
2,385,816 A * 10/1945 Krupp ..... 24/387
(Continued)

FOREIGN PATENT DOCUMENTS

CN 2139789 Y 8/1993
EP 2071972 A1 6/2009
(Continued)

OTHER PUBLICATIONS

International Search Report and Written Opinion, PCT International Application No. PCT/JP2009/070134, mailed Mar. 2, 2010.
(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

There is provided a liquid-tight slide fastener capable of sufficiently ensuring waterproof property regardless of where fastener elements are formed and capable of sufficiently ensuring attachment strength of the fastener elements to fastener tapes provided with liquid-tight layers. There is also provided a manufacturing method for the liquid-tight slide fastener. The liquid-tight slide fastener includes a pair of fastener tapes that include a pair of tape members, core sections respectively provided on opposing tape edges of the pair of tape members, and liquid-tight layers formed on one side of the pair of tape members; a pair of fastener element rows; and a slider. The liquid-tight layers are formed with gaps to the core sections in a width direction of the fastener tapes. The fastener elements are attached to the core sections.

4 Claims, 12 Drawing Sheets

(51) Int. Cl.

| | |
|---|---|
| ***B05D 1/38*** | (2006.01) |
| ***B05D 5/00*** | (2006.01) |
| ***A44B 19/02*** | (2006.01) |

(56) References Cited

U.S. PATENT DOCUMENTS

| | | | | | |
|---|---|---|---|---|---|
| 2,477,563 | A | * | 8/1949 | Angus | 150/157 |
| 2,746,113 | A | * | 5/1956 | Williams | 24/389 |
| 2,800,699 | A | * | 7/1957 | Armstrong | 24/387 |
| 2,814,847 | A | * | 12/1957 | Zbinden | 24/434 |
| 2,841,851 | A | * | 7/1958 | Van Amburg et al. | 24/384 |
| 3,046,627 | A | * | 7/1962 | Morin | 24/433 |
| 4,765,038 | A | | 8/1988 | Kasai | |
| 5,755,014 | A | * | 5/1998 | Yamaguchi et al. | 24/433 |
| 6,112,376 | A | * | 9/2000 | Akashi et al. | 24/433 |
| 6,205,626 | B1 | * | 3/2001 | Watanabe et al. | 24/434 |
| 6,497,014 | B2 | * | 12/2002 | Neugebauer | 24/389 |
| 6,622,351 | B2 | * | 9/2003 | Takasawa | 24/415 |
| D556,632 | S | * | 12/2007 | Cossutti | D11/221 |

FOREIGN PATENT DOCUMENTS

| | | | |
|---|---|---|---|
| FR | 2031971 | A5 | 11/1970 |
| JP | 40-17549 | Y1 | 6/1965 |
| JP | 58-175714 | | 11/1983 |
| JP | 60-20815 | | 2/1985 |
| JP | 63-013687 | | 4/1988 |

OTHER PUBLICATIONS

Supplementary European Search Report, European Patent Application No. 09851682.6, mailed Sep. 13, 2013.

Office Action, Japanese Patent Application No. 2011-543066, mailed Nov. 19, 2013.

Office Action, Chinese Patent Application No. 200980162676.8, mailed Apr. 25, 2014.

* cited by examiner

LIQUID-TIGHT SLIDE FASTENER

This application is a national stage application of PCT/JP 2009/070134 which is incorporated herein by reference.

TECHNICAL FIELD

The present invention relates to a liquid-tight slide fastener and a manufacturing method therefor.

BACKGROUND ART

As is known in the related art, a liquid-tight slide fastener includes a pair of fastener tapes in which enlarged core sections are formed on opposing tape edges of a pair of tape members, the entire portion of the tape members is covered with liquid-tight layers made of synthetic resin so as to avoid permeation of water, and fastener elements which are made of resin and injection-molded on the tape edges of the pair of fastener tapes. In the liquid-tight slide fastener, when the fastener is closed by engaging the fastener elements with each other, leading ends of the fastener elements comes in contact with the liquid-tight layer of the opposing fastener tape to exercise watertight property (e.g. Patent Document 1).

PRIOR ART DOCUMENT

Patent Document

Patent Document 1: Japanese Patent Application Publication No. S63-013687

SUMMARY OF INVENTION

Problems to Be Solved by Invention

When the entire portion of the tape members is covered with the liquid-tight layers, the fastener elements are formed on the respective liquid-tight layers. If the fixing strength between the fastener elements and the liquid-tight layers is not sufficient, the fastener elements may be detached from the fastener tapes. For this reason, in the liquid-tight slide fastener described in Patent Document 1, through-holes are formed at edges of the fastener tapes and the fastener elements are formed through the through-holes so that the fastener elements are strongly attached to the fastener tapes.

However, in the liquid-tight slide fastener described in Patent Document 1, since the through-holes are formed in the fastener tapes, if the fastener elements are formed in positions misaligned from the through-holes, the watertight property become impaired. Thus, high accuracy is required in positioning of the fastener elements. In addition, it is difficult to form the liquid-tight layers on the expanded cores. If the core sections are deformed when forming the liquid-tight layers, the attachment strength of the fastener elements may degrade.

The present invention has been made keeping in mind the foregoing circumstances, and objects of the present invention are to provide a liquid-tight slide fastener capable of sufficiently ensuring the watertight property regardless of where the fastener elements are formed and capable of sufficiently ensuring attachment strength of the fastener elements to fastener tapes and to provide a manufacturing method therefor.

Means for Solving Problems

The foregoing objects of the present invention are realized by the following configurations:

(1) A liquid-tight slide fastener, characterized by a pair of fastener tapes comprising a pair of tape members, core sections respectively provided on opposing tape edges of the pair of tape members, the core sections being expanded from the tape members, and liquid-tight layers respectively formed on one side of the pair of tape members; a pair of fastener element rows respectively provided on the pair of fastener tapes, and comprised of a plurality of fastener elements; and a slider which causes the pair of fastener element rows to engage with and disengage from each other, wherein the liquid-tight layers are formed with gaps to the core sections in a width direction of the fastener tapes, and wherein the fastener elements are attached to the core sections.

(2) The liquid-tight slide fastener according to (1), characterized in that the fastener elements have base sections attached to the core sections and the tape members, and in that the liquid-tight layers are in contact with the base sections of the fastener elements.

(3) The liquid-tight slide fastener according to (1), characterized in that water repellent or oil repellent is attached to the tape members, the core sections, the liquid-tight layers, and the fastener elements.

(4) The liquid-tight slide fastener according to (1), characterized in that the fastener elements have base sections attached to the core sections and the tape members, and in that in a side of the respective tape members at which the respective liquid-tight layers are formed, an area of a portion of the respective base sections, that is formed above the respective tape members in a range between the respective core sections and the respective liquid-tight layers is greater than an area of a portion of the respective base sections, that is formed above the respective liquid-tight layers.

(5) The liquid-tight slide fastener according to (1) or (2), characterized in that respective edges of the respective liquid-tight layers at a side of the respective core sections are formed toward the respective core sections beyond respective outer ends of flanges of the slider in a width direction thereof.

(6) A manufacturing method for a liquid-tight slide fastener comprising a pair of fastener tapes comprising a pair of tape members which are continuous in a longitudinal direction thereof, core sections respectively provided on opposing tape edges of the pair of tape members, the core sections being expanded from the tape members, and liquid-tight layers respectively formed on one side of the pair of tape members, a pair of fastener element rows respectively provided on the pair of fastener tapes, and comprised of a plurality of fastener elements, and a slider which causes the pair of fastener element rows to engage with and disengage from each other, the manufacturing method characterized by the steps of forming the liquid-tight layers on the one side of the tape members; injection-molding the fastener elements on the fastener tapes, which have the liquid-tight layers of the foregoing step, thereby producing a continuous fastener chain; and attaching water repellent or oil repellent to the fastener chain.

Advantageous Effects of Invention

According to the liquid-tight slide fastener of the present invention, since it is not required to form the fastener elements through the through-holes which are formed on the fastener tapes as the related art, it is possible to sufficiently ensure the watertight property of the liquid-tight slide fastener regardless of the positions where the fastener elements are formed. In addition, since it is possible to form the liquid-type layers on the tape members without deforming the core sections, it is possible to sufficiently ensure the attachment strength of the fastener elements to the fastener tapes provided with the liquid-tight layers.

MODE TO CARRY OUT INVENTION

Figure 1:
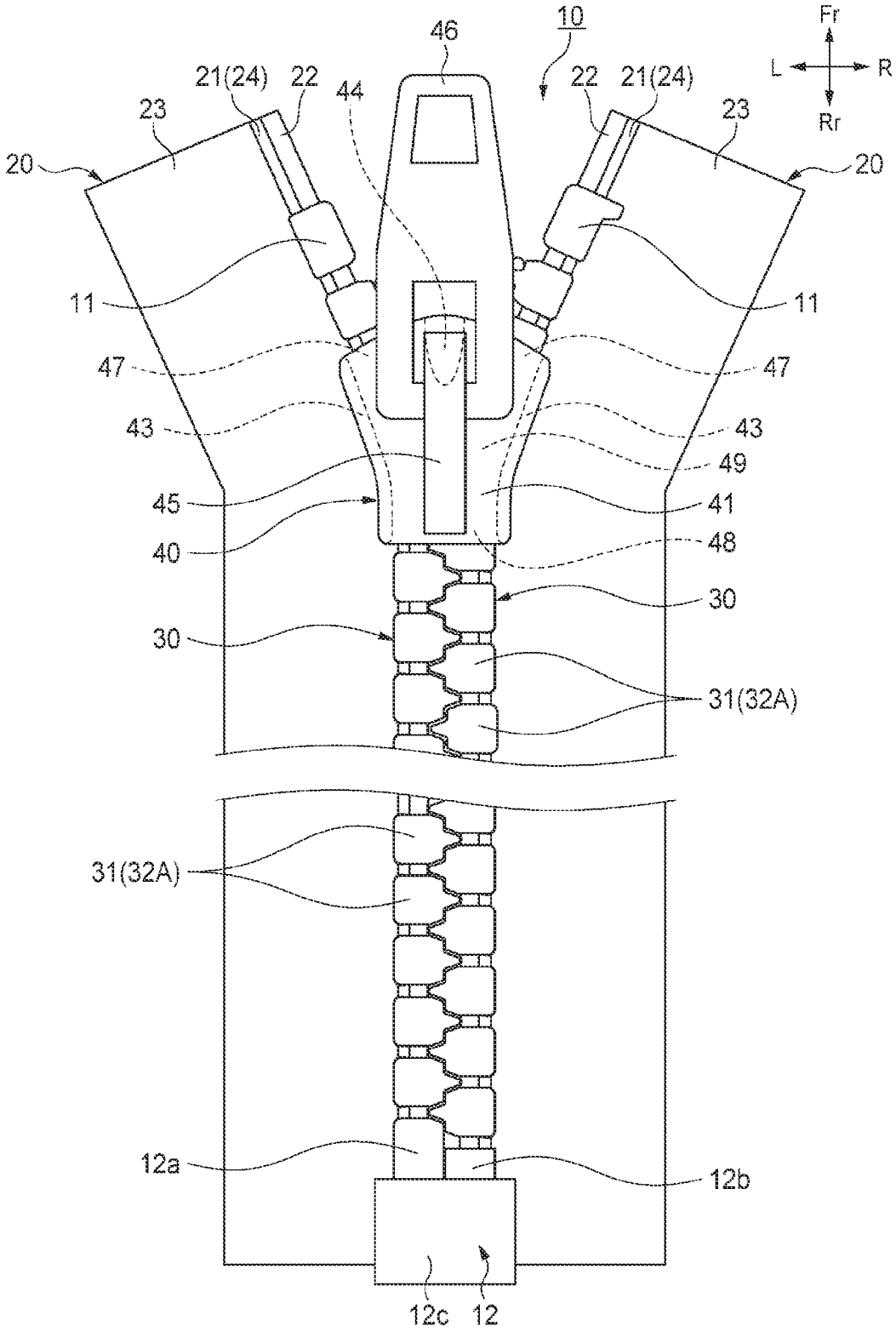
FIG. 1 is a obverse side view depicting a first embodiment of a liquid-tight slide fastener according to the present invention.

Hereinafter, various embodiments of a liquid-tight slide fastener according to the present invention will be described in detail with reference to the accompanying drawings. In the following description, as for the fastener tapes, a obverse side refers to a near side with respect to the paper surface of FIG. 1 (i.e. a side of a slider 40 at which a pull tab 46 is provided, as will be described later), a reverse side refers to a far side with respect to the paper surface of FIG. 1 (i.e. a reverse side of the slider 40, at which the pull tab 46 of FIG. 1 is not provided, as will be described later), a front side refers to an upper side with respect to the paper surface of FIG. 1 (i.e. a side of a direction in which the slider 40 is slid to engage fastener element rows 30 of a slide fastener 10, as will be described later), a rear side refers to a lower side with respect to the paper surface of FIG. 1 (i.e. a side of a direction in which the slider 40 is slid to disengage the fastener elements 30, as will be described later), a left side refers to a left side with respect to the paper surface of FIG. 1, and a right side refers to a right side with respect to the paper surface of FIG. 1 (a right-left direction can also be referred to as a width direction of the fastener tapes 20 and an upper-lower direction can also be referred to as a longitudinal direction of the fastener tapes 20). In the figures, the obverse side is indicated by Hs, the reverse side is indicated by Bs, the front side is indicated by Fr, the rear side is indicated by Rr, the left side is indicated by L, and the right side is indicated by R. In addition, as for the slider, the obverse side of the fastener tapes is referred to as the upper side, and the reverse side of the fastener tapes is referred to as the lower side.

[First Embodiment]

First, with reference to FIG. 1 to FIG. 9, a first embodiment of the liquid-tight slide fastener according to the present invention will be described.

Figure 2:
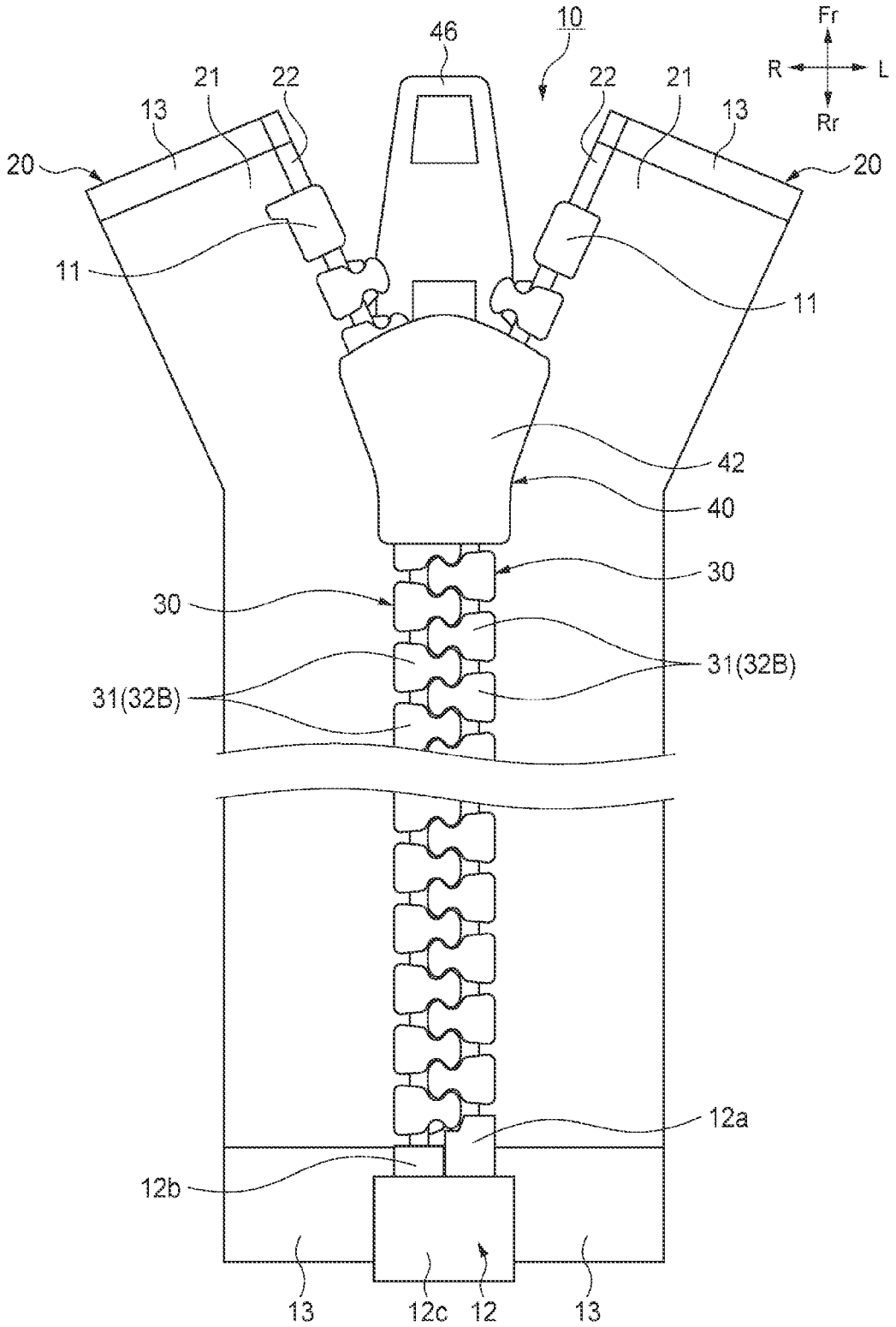
FIG. 2 is a reverse side view of the liquid-tight slide fastener shown in FIG. 1.
Figure 3:
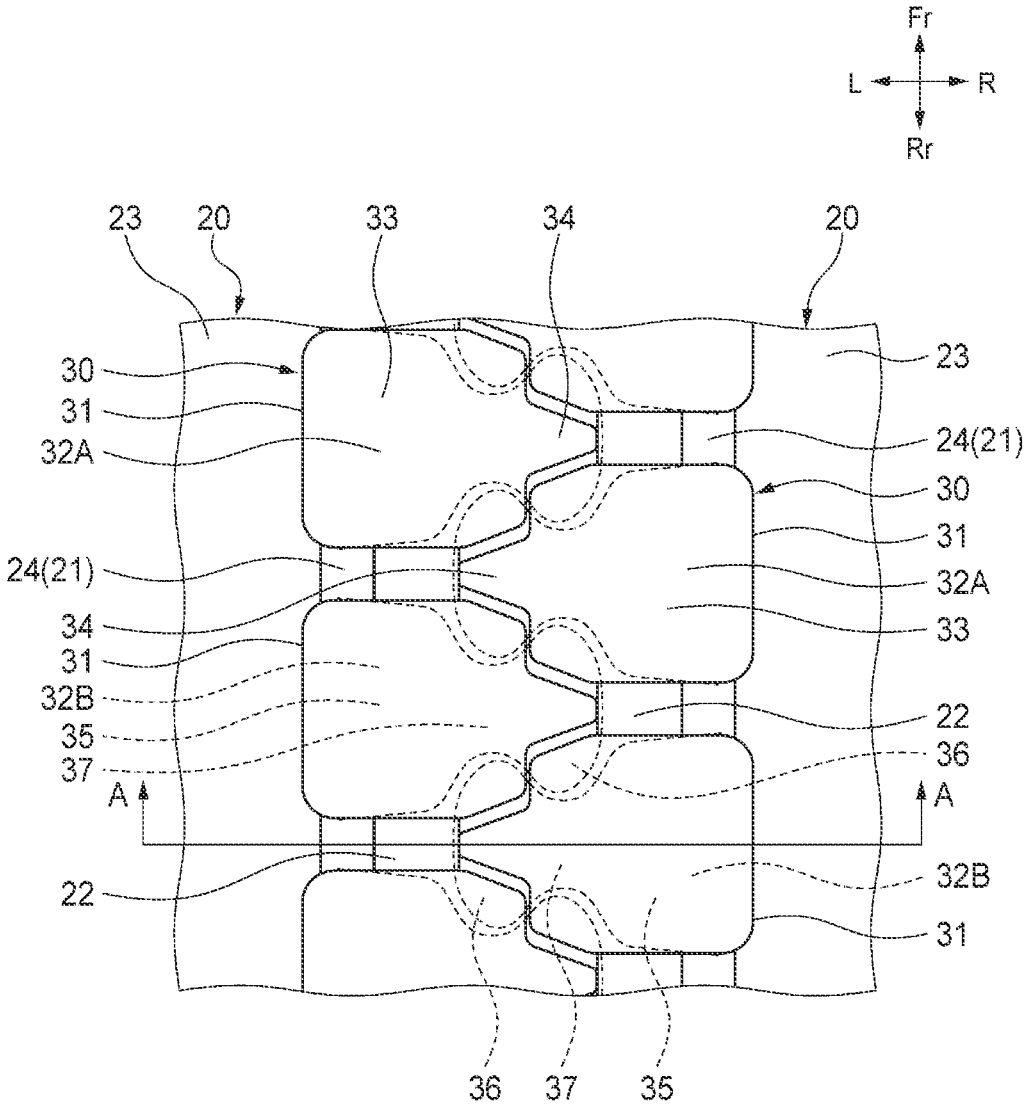
FIG. 3 is an exploded obverse side view around the fastener elements shown in FIG. 1.

As shown in FIG. 1 and FIG. 2, the liquid-tight slide fastener 10 of this embodiment includes a pair of left and right fastener tapes 20, a pair of left and right fastener element rows 30 which are respectively provided on the left and right fastener tapes 20, and a slider 40 which causes the left and right fastener element rows 30 to engage with and disengage from each other. By moving the slider 40 in forward and backward direction, the left and right fastener element rows 30 are engaged with and disengaged from each other. In FIG. 1, reference numeral 11 indicates top end stops, reference numeral 12 indicates a separable end stop, which includes an insert pin 12*a*, a box pin 12*b* and a box body 12*c*. Bottom end stops may be attached instead of the separable end stop 12. In addition, reference numeral 13 in FIG. 2 refers to a reinforcing film.

As shown in FIG. 1 to FIG. 4, the pair of left and right fastener tapes 20 includes a pair of tape members 21 which are continuous in the longitudinal direction thereof and are arranged in parallel in the width direction thereof, expanded core sections 22 which are respectively provided on opposing tape edges of the tape members 21 and are thick in the obverse and reverse direction of the tape members 21, and liquid-tight layers 23 respectively formed on the obverse side of the pair of left and right tape members 21.

In this embodiment, as shown in FIG. 5 to FIG. 8, respective liquid-tight layers 23 are formed with gaps to the core sections 22 in the width direction of the fastener tapes 20. Accordingly, tape-exposing sections 24 in which the tape members 21 are exposed to the obverse side, are formed in the range between the core sections 22 and the liquid-tight layers 23. In addition, the liquid-tight layers 23 are formed by bonding film-shaped material to the tape members 21, or by applying thinly molten resin on the tape members 21 to coat the tape member 12 with the molten resin. The tape members 21 on which the liquid-tight layer 23 is to be formed, is for example woven. Since a flat weave has a better outward appearance, it is preferred that same weaves, such as a 1-1 plain weave, 2-2 plain weave, or a twill weave, be woven substantially throughout the entire width of the tape. Of course, the tape member 21 may be knitted. The core sections 22 are prepared by weaving (knitting) core materials which are thicker than the tape members 21 during weaving (knitting) of the tape members 21. The liquid-tight layers 23 are prepared by applying adhesive on film-shaped material made of thermoplastic synthetic resin having elastomer characteristics (thermoplastic elastomer), and by bonding them to the tape members 21.

Each of the pair of left and right fastener element rows 30 is comprised of a plurality of fastener elements 31. The fastener elements 31 are formed by injection-molding synthetic resin, for example, polyamide, polyacetal, polypropylene, polybutyleneterephthalate, or the like, on the core sections 22 and the tape members 21 of the fastener tapes 20.

As shown in FIG. 5 to FIG. 8, each of the fastener element 31 is integrally formed with obverse side section 32A which is to be disposed on the obverse side of the fastener tapes 20, and an reverse side section 32B which is to be disposed on the reverse side of the fastener tapes 20.

The obverse side section 32A has a first base section 33 which is attached to the core section 22, the tape-exposing section 24, and the liquid-tight layer 23, and a first head section 34 which extends from the first base section 33 toward the counterpart fastener tape 20 and comes into contact with an edge of the core section 22 of the counterpart fastener tape 20.

The reverse side section 32B has a second base section 35 which is attached to the reverse side of the core section 22 and the tape member 21, a second head section 36 which extends from the second base section 35 toward the counterpart fastener tape 20 and engages with the reverse side section 32B of the adjacent fastener element 31, and a neck section 37 which is formed between the second base section 35 and the second head section 36 and the width of which is narrower than the second head section 36 in the forward and backward direction.

Figure 6:
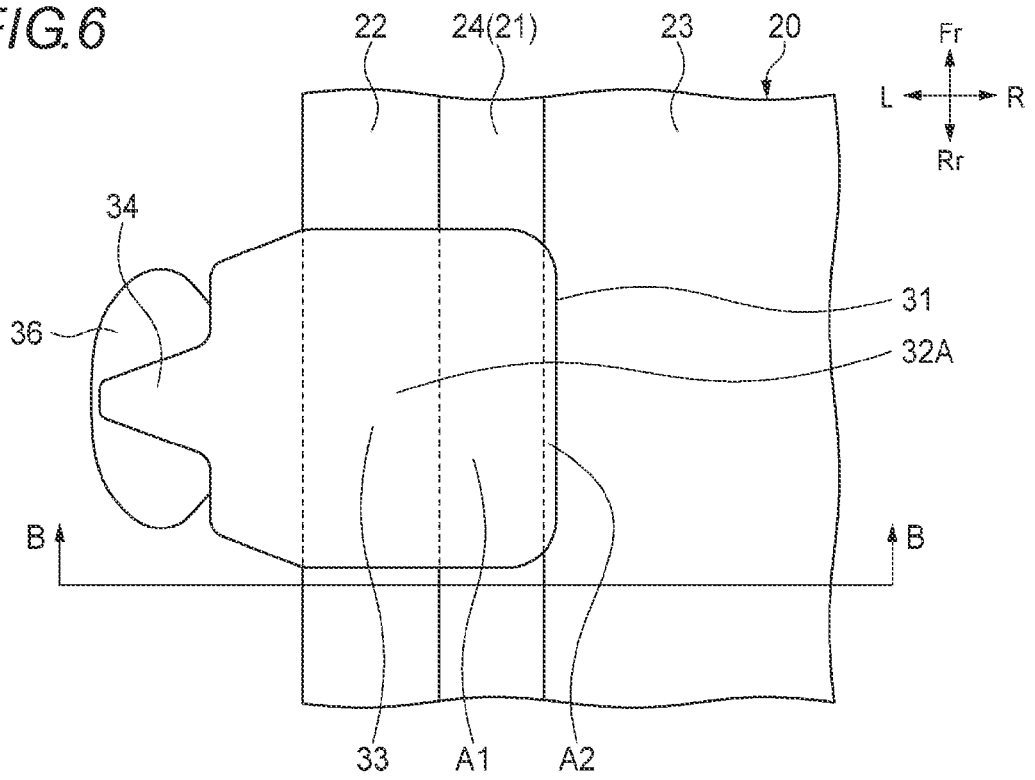
FIG. 6 is an exploded obverse side view around the fastener elements which are disengaged.
Figure 7:
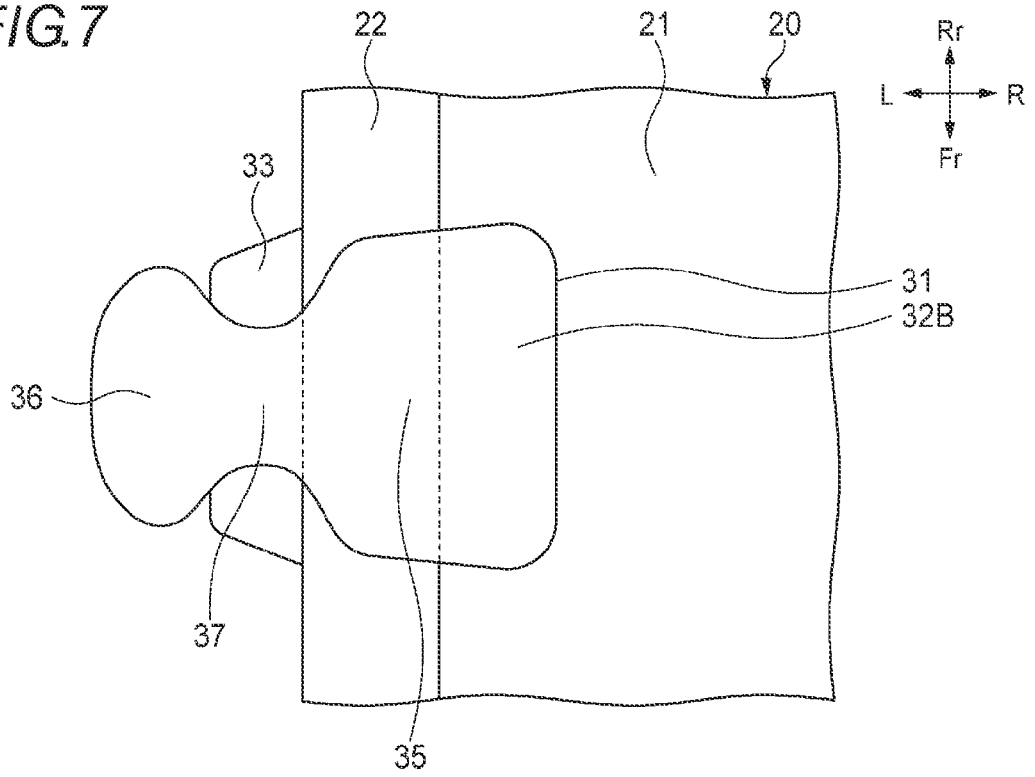
FIG. 7 is an exploded reverse side view around the fastener elements which are disengaged.

In this embodiment, as shown in FIG. 6, an area A1 of a portion of the first base section 33 of the obverse side section 32A, that is formed above the tape-exposing section 24 is set so as to be greater than an area A2 of a portion of the first base section 33 of the obverse side section 32A, that is formed above the liquid-tight layer 23.

Figure 4:
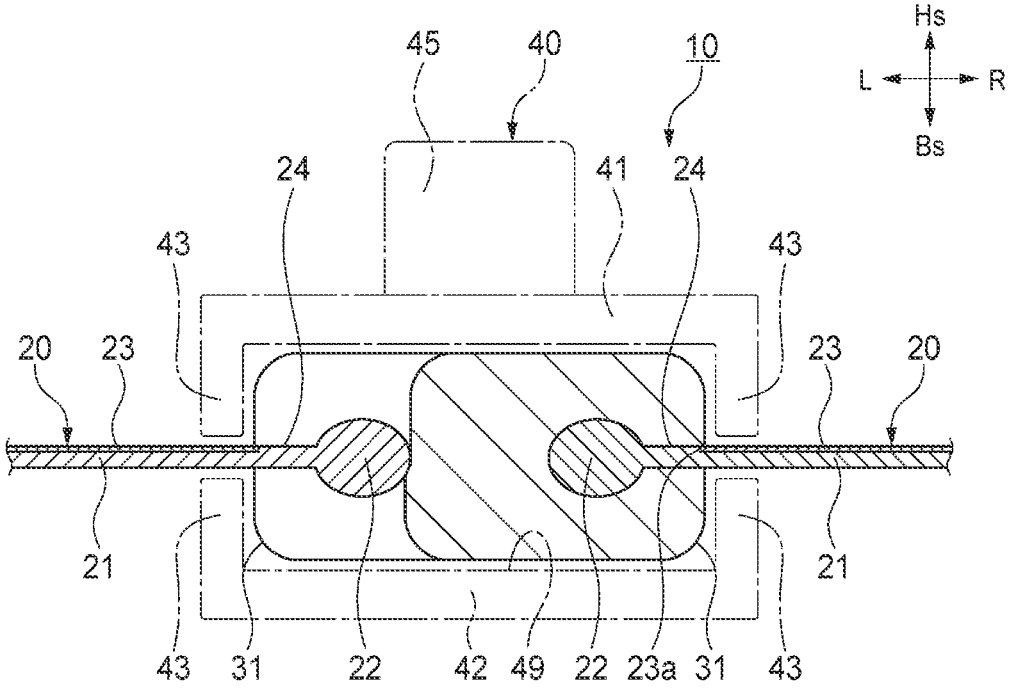
FIG. 4 is a cross-sectional view at a line A-A in FIG. 3.
Figure 5:
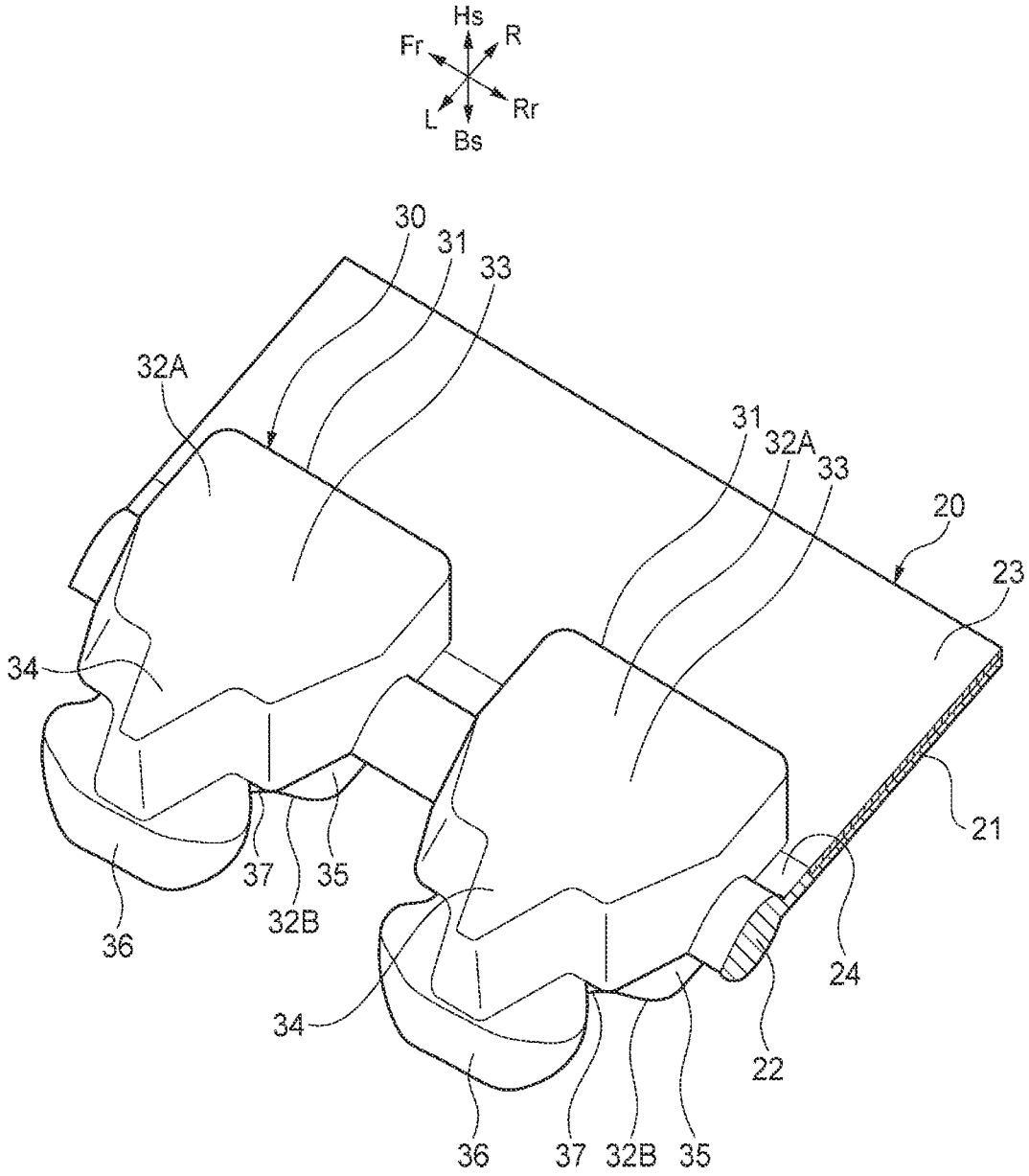
FIG. 5 is an exploded perspective view around the fastener elements which are disengaged.

As shown in FIG. 1, FIG. 2 and FIG. 4, the slider 40 includes an upper blade 41 and a lower blade 42 which are spaced apart from each other in the upper-lower direction and arranged in parallel to each other, a pair of left and right flanges 43 which are provided along both left and right edges of the upper blade 41 and the lower blade 42 so as to protrude in a mutually approaching direction, a guide post 44 which connects the upper blade 41 and the lower blade 42 at front ends thereof, a pull tab-attaching section 45 provided on the upper surface of the upper blade 41, and a pull tab 46 which is rotatably attached to the pull tab-attaching section 45. The flanges 43 slidably contact the ends of the base sections 33 and 35 of the fastener elements 31 at an outer side in the width direction (a side opposite to the head sections 34 and 36). In this way, left and right shoulder mouths 47 which are separated by the guide post 44 are formed in the front side of the slider 40 and a rear mouth 48 is formed in the rear side of the slider 40. An element guide passage 49 having substantially Y-shape so as to communicate the left and right shoulder mouths 47 with the rear mouth 48 is provided between the upper blade 41 and the lower blade 42. The element guide passage 49 constitutes a passage for passing the pair of left and right fastener element rows 30 therethrough. With this configuration, the fastener element 31 which has entered the element guide passage 49 from the left and right shoulder mouths 47 is moved toward the rear mouth due to the sliding of the slider 40 so as to engage with the opposite fastener element row 30. In the case of separation, the movement is performed in the reverse way.

Figure 8:
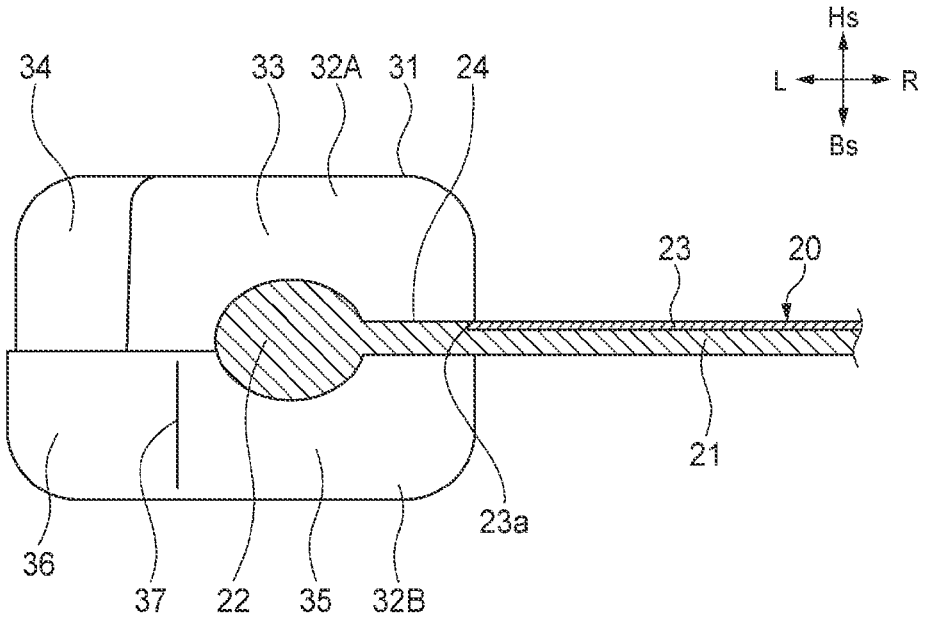
FIG. 8 is a cross-sectional view at a line B-B in FIG. 6.

In this embodiment, as shown in FIG. 4 and FIG. 8, respective edges 23*a* of the liquid-tight layers 23 at a side of the respective core sections 22 are formed toward the respective core sections 22 beyond respective outer ends of the pair of left and right flanges 43 in the width direction thereof.

In addition, in this embodiment, water repellent or oil repellent is attached to the fastener tapes 20 and the fastener element rows 30. In order to attach the water repellent or oil repellent, a continuous fastener chain in which a plurality of fastener tapes 20 and a plurality of fastener element rows 30 are continued is immersed into a vessel that is filled with the water repellent or oil repellent. Afterwards, the water repellent or oil repellent is dried and the fastener chain is heated to attach the water repellent or oil repellent to the fastener chain. The water repellent which is attached in this way prevents water from being absorbed by or permeating into a portion on which the liquid-tight layer 23 is not formed, and thus watertight property is sufficiently ensured.

As described above, according to the liquid-tight slide fastener 10 of this embodiment, since the liquid-tight layers 23 are formed with gaps to the core sections 22 in the width direction and the fastener elements 31 are attached to the core sections 22 and the tape members 21, it is not necessary to form the fastener elements through through-holes which are formed in the fastener tapes as the related art. Accordingly, it is possible to sufficiently ensure the watertight property of the liquid-tight slide fastener 10 regardless of the positions where the fastener elements 31 are formed.

In addition, according to the liquid-tight slide fastener 10 of this embodiment, since the liquid-tight layers 23 are formed with gaps to the core sections 22, it is possible to form the liquid-tight layers 23 on the tape members 21 without deforming the core sections 22. Accordingly, it is possible to sufficiently ensure the attachment strength of the fastener elements 31 to the fastener tapes 20 provided with the liquid-tight layers 23.

In addition, according to the liquid-tight slide fastener 10 of this embodiment, since the area A1 of the portion of the first base section 33 of the respective fastener elements 31, that is formed above the tape-exposing section 24 in the range between the respective core sections 22 and the respective liquid-tight layers 23 is greater than the area A2 of the portion of the first base section 33 of the respective fastener elements 31, that is formed above the respective liquid-tight layers 23, most of the first base section 33 of the respective fastener elements 31 is formed on the respective tape members 21 to which synthetic resin can be easily attached relative to the liquid tight layers 23. Accordingly, it is possible to increase the attachment strength of the fastener elements 31 to the fastener tapes 20.

In addition, according to the liquid-tight slide fastener 10 of this embodiment, the respective edges 23*a* of the respective liquid-tight layers 23 at the side of the respective core sections 22 are formed toward the respective core sections 22 beyond the respective outer ends of the pair of left and right flanges 43 of the slider 40 in the width direction thereof. Therefore, when the slider 40 is moved, the edges 23*a* of the liquid-tight layers 23 are positioned in the reverse side direction of the flanges 43. This makes it difficult for the edges 23*a* of the liquid-tight layers 23 to be caught by the flanges 43 when the slider 40 is being slid, thereby ensuring endurance for long-time use.

Figure 9:
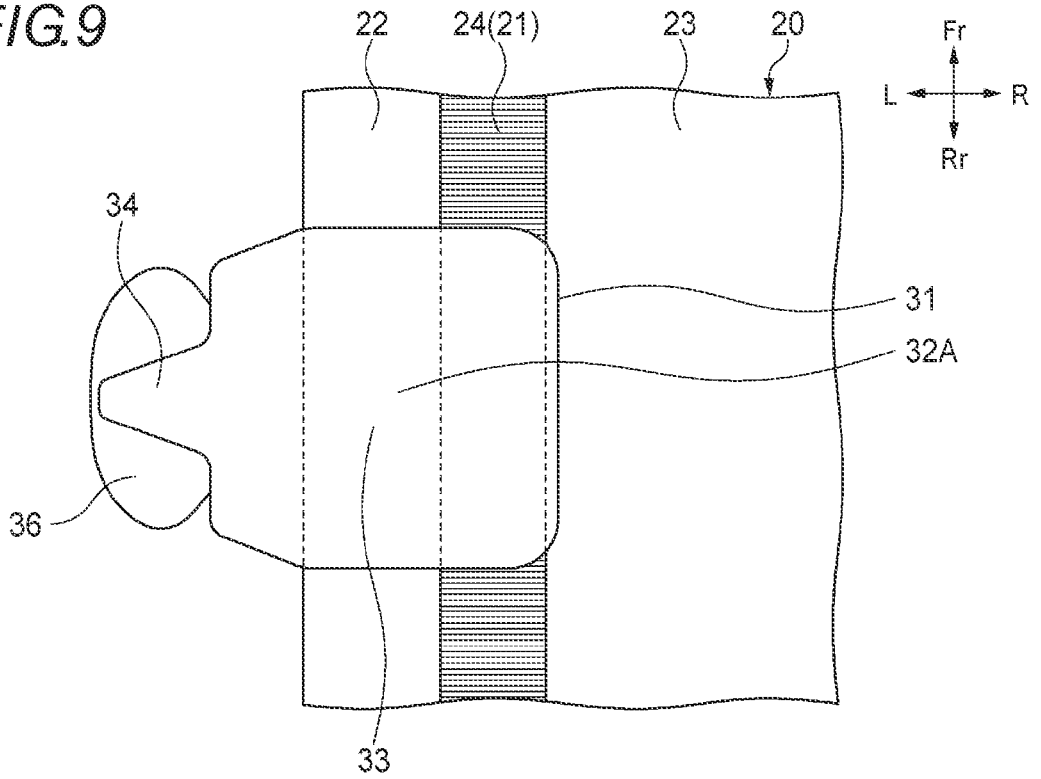
FIG. 9 is an exploded obverse side view depicting a variation of the liquid-tight slide fastener of the first embodiment.

As a variation of this embodiment, as shown in FIG. 9, a portion of the tape-exposing section 24 which is the range between the respective core sections 22 of the tape members 21 and the respective liquid-tight layers 23 may be formed as a warp-free area which is a weave entirely composed of weft without warp. In this case, the synthetic resin of the fastener elements 31 passes through the warp-free area such that the first base section 33 and the second base section 35 are coupled with each other in the obverse and reverse direction, thereby further increasing the attachment strength of the fastener elements 31 to the fastener tapes 20. The warp-free area can be formed by weaving water-soluble warp when the weaving of the tape members 21, and then dissolving the water-soluble warp, for example, in a dyeing process.

The liquid-tight layers 23 are layer-shaped portion that can prevent liquid such as water or oil from passing therethrough. In addition, the watertight property is determined by a rain-water test using a rainmaking apparatus, in which water is showered over the liquid-tight slide fastener 10 which is in engaged state, and the both the amount (weight) of water that has passed through the liquid-tight slide fastener 10 and the amount (weight) of water that is contained in the liquid-tight slide fastener 10 are compared with reference values. In some cases, the desired watertight property of the liquid-tight slide fastener 10 may vary depending on the field to which the liquid-tight slide fastener 10 is applied or customers' demand, and thus in the present invention it is determined that there is the watertight property when the amount of water passing through or contained in the slide fastener is small relative to usual slide fasteners.

[Second Embodiment]

A description will be given below of a second embodiment of the liquid-tight slide fastener according to the present invention with reference to FIG. 10 to FIG. 12. As for parts that are identical or similar to those of the above-described first embodiment of the present invention, the same reference numerals are used throughout the drawings, and a description thereof will be omitted or simplified.

Figure 10:
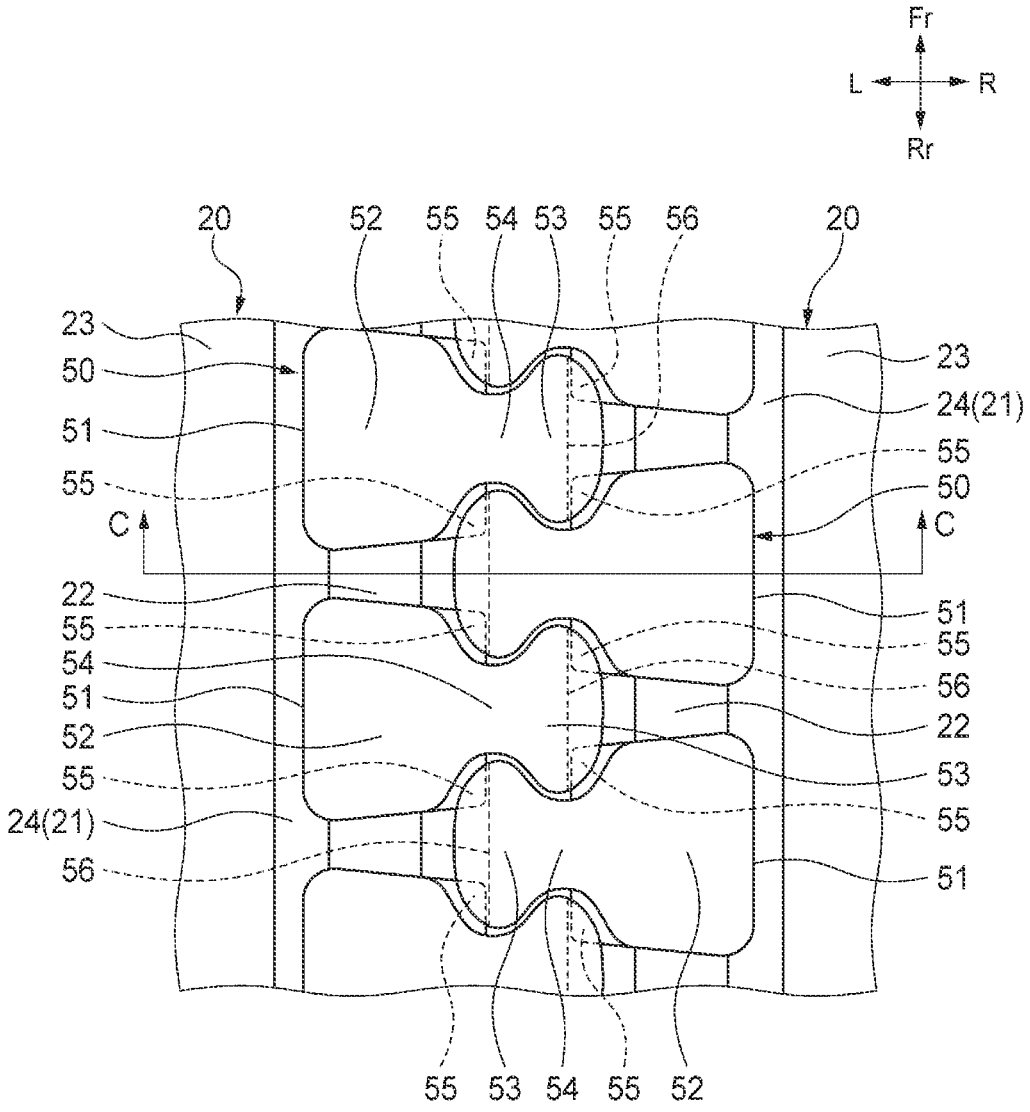
FIG. 10 is an exploded obverse side view around fastener elements, depicting a second embodiment of the liquid-tight slide fastener according to the present invention.
Figure 11:
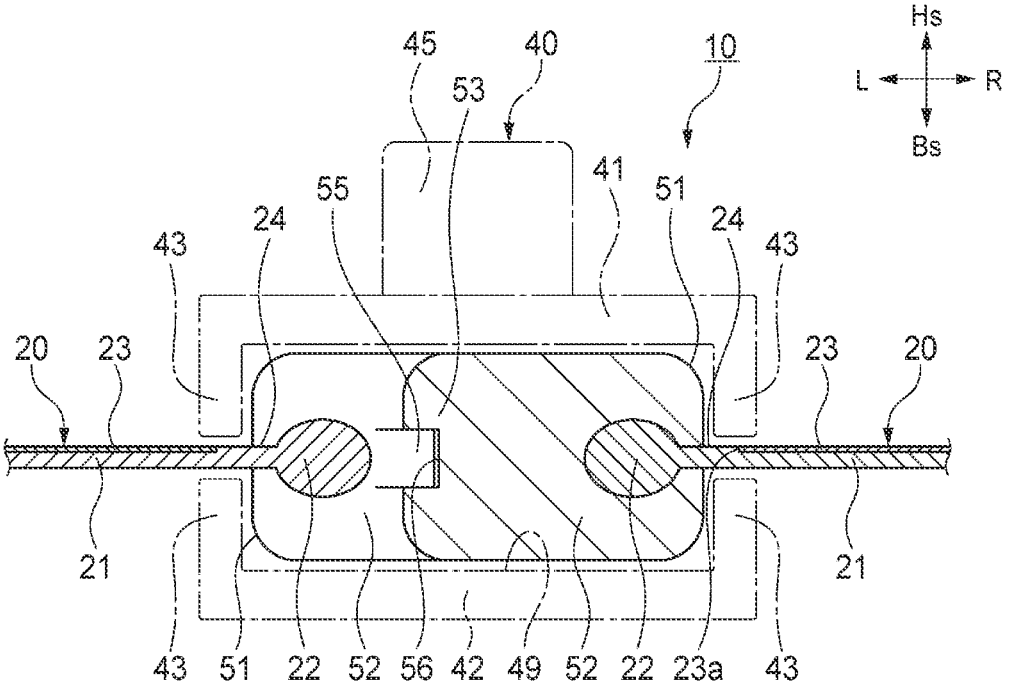
FIG. 11 is a cross-sectional view at a line C-C in FIG. 10.
Figure 12:
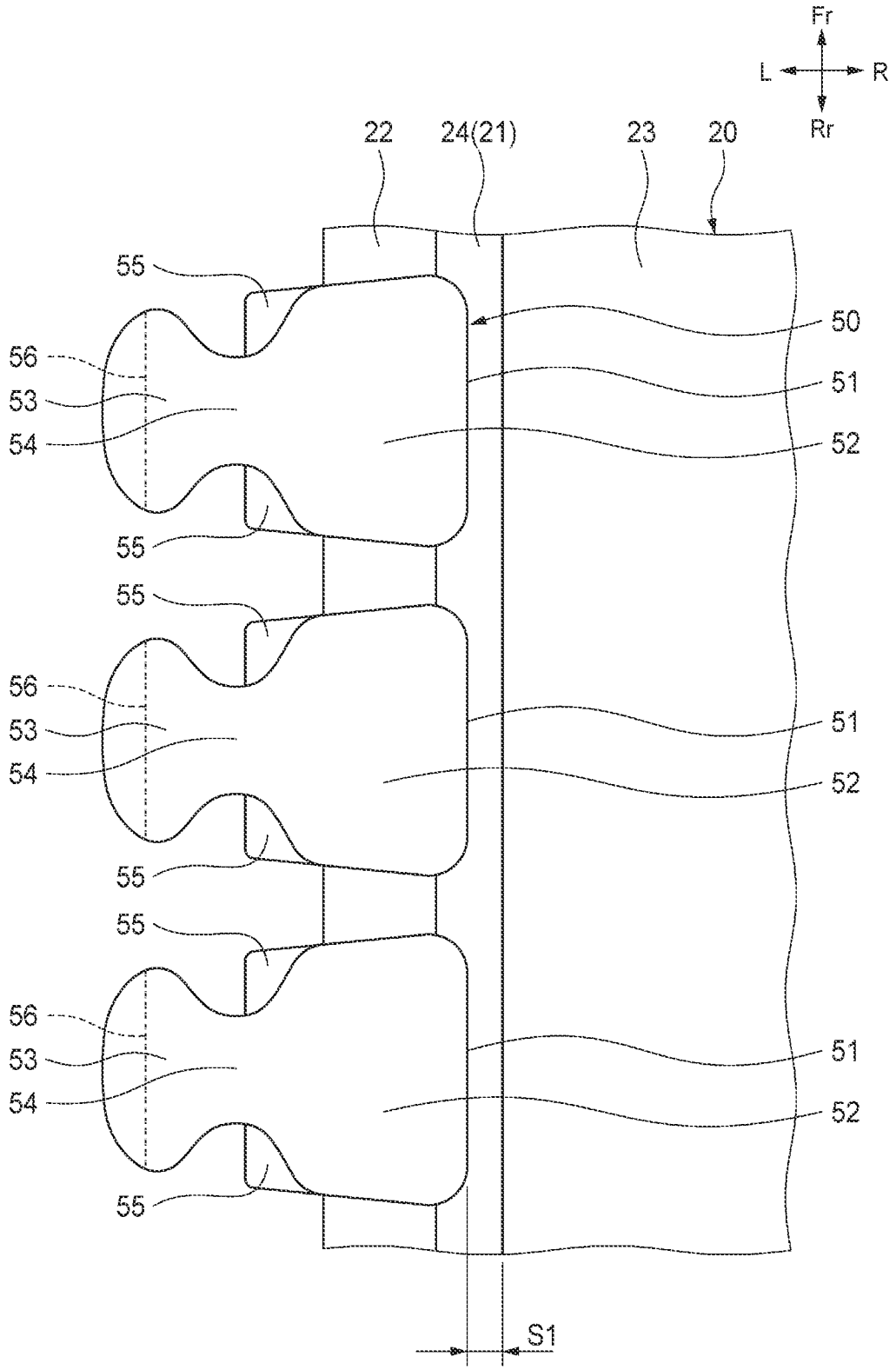
FIG. 12 is an exploded obverse side view around the fastener elements which are disengaged.

In the liquid-tight slide fastener 10 of this embodiment, as shown in FIG. 10 to FIG. 12, in place of the fastener element rows 30, fastener element rows 50 are injection-molded on the fastener tapes 20, respectively.

Each of the fastener element rows 50 is comprised of a plurality of fastener elements 51. Each of the fastener elements 51 is provided with a base section 52 attached to the respective core sections 22, a head section 53 extending from the base section 52 toward the counterpart fastener tape 20 and engaging with an adjacent fastener element 51, a neck section 54 formed between the base section 52 and the head section 53 and the width thereof being narrower in the frontward and backward direction than that of the head section 53, a pair of plate-shaped shoulder sections 55 formed on both sides in the frontward and backward direction between the base section 52 and the neck section 54, and shoulder-receiving recesses 56 formed at the leading edge of the head section 53 along the frontward and backward direction to receive the shoulder sections 55 and 55 of counterpart fastener elements 51 and 51. In this embodiment, although the head section 53 does not contact the edge of the core section 22 of the counterpart fastener tape 20, the water repellent that is attached thereto repels water. Accordingly, it can be regarded that this embodiment has the watertight property compared with those to which water repellent is not attached.

In addition, in this embodiment, as shown in FIG. 10 to FIG. 12, a gap S1 through which the tape-exposing section 24 is exposed to the obverse side is formed between the base section 52 of the respective fastener elements 51 and the respective liquid-tight layers 23.

The other components are the same as those of the first embodiment.

In addition, the fastener tapes 20 of the first embodiment may be configured as that of the second embodiment. In the second embodiment, the base section 52 of the respective fastener elements 51 and the respective liquid-tight layers 23 may contact each other. With this configuration, it is possible to increase the range of the liquid-tight layers 23. In addition, as for this slide fastener, the thickness of the respective tape members 21 is about half the thickness of the respective core sections 22 (i.e. the dimension in the obverse-reverse direction), and the thickness of the respective liquid-tight layers 23 is about ⅙ of the thickness of the respective tape members 21. Specifically, the thickness of the respective core sections 22 is about 1.3 mm, the thickness of the respective tape members 21 is 0.65 mm, and the thickness of the respective liquid-tight layers 23 is 0.1 mm. In the first embodiment, the thickness of a portion of the respective liquid-tight layers 23 is substantially the same as that of the respective tape members 21, since the portion is crushed by an upper mold 61 and a lower mold 62.

Now, with reference to FIG. 13, a description will be given of a manufacturing method for a liquid-tight slide fastener according to the present invention.

Figure 13:
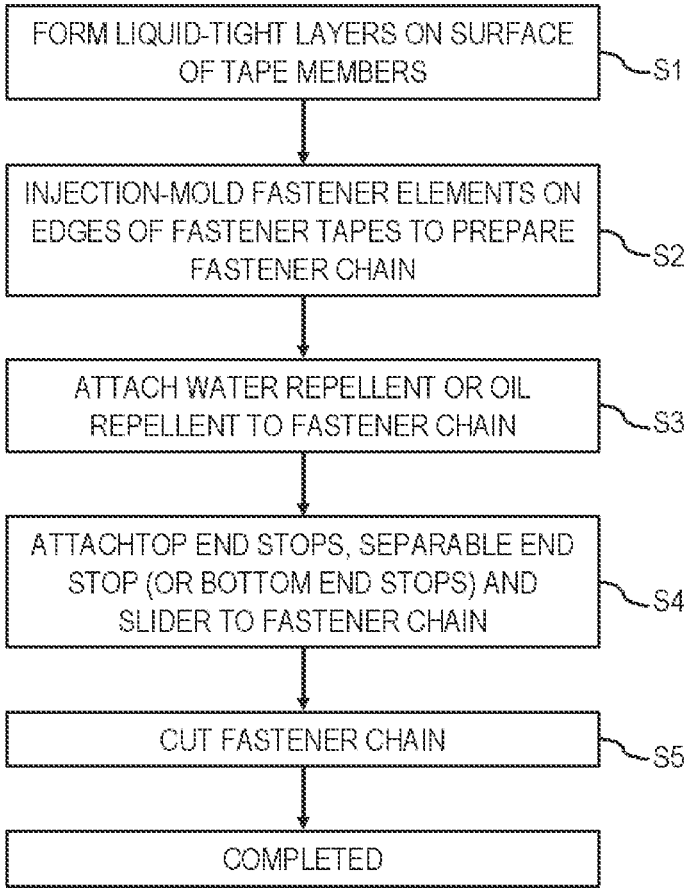
FIG. 13 is a flowchart depicting a manufacturing method for a liquid-tight slide fastener according to the present invention.

In the manufacturing method of this embodiment, first, as presented in step S1 of FIG. 13, liquid-tight layers 23 are formed on the surface of tape members 21. In sequence, as presented in step S2, a continuous fastener chain is prepared by injection-molding fastener elements 31 (51) on the edges of fastener tapes 20 having the liquid-tight layers 23 produced in the former process. In sequence, as presented in step S3, water repellent or oil repellent is attached to the fastener chain. Since the water repellent or the oil repellent is attached to all of the tape members 21, the core sections 22 and the liquid-tight layers 23 of the fastener tapes 20 and the fastener elements 31 (51), further enhanced water/oil resistant effects can be obtained. Afterwards, as presented in step S4, top end stops 11, a separable end stop 12 and a slider 40 are attached to the fastener chain. In addition, as presented in step S5, the fastener chain is cut at a predetermined position, thereby producing a liquid-tight slide fastener 10 of this embodiment. In the meantime, the process of step S1 and the process of step S2 may be in the reverse sequence. That is, the liquid-tight layers 23 may be formed on the tape members 21 after the fastener elements 31 (51) are formed on the fastener tapes 20.

Figure 14:
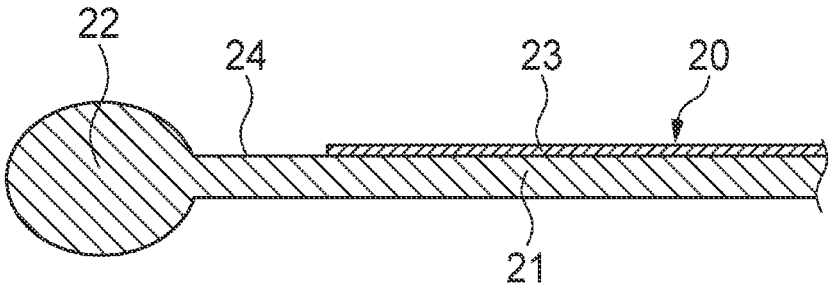
FIG. 14 is an exploded cross-sectional view depicting a fastener tape, before fastener elements are injection-molded.
Figure 15:
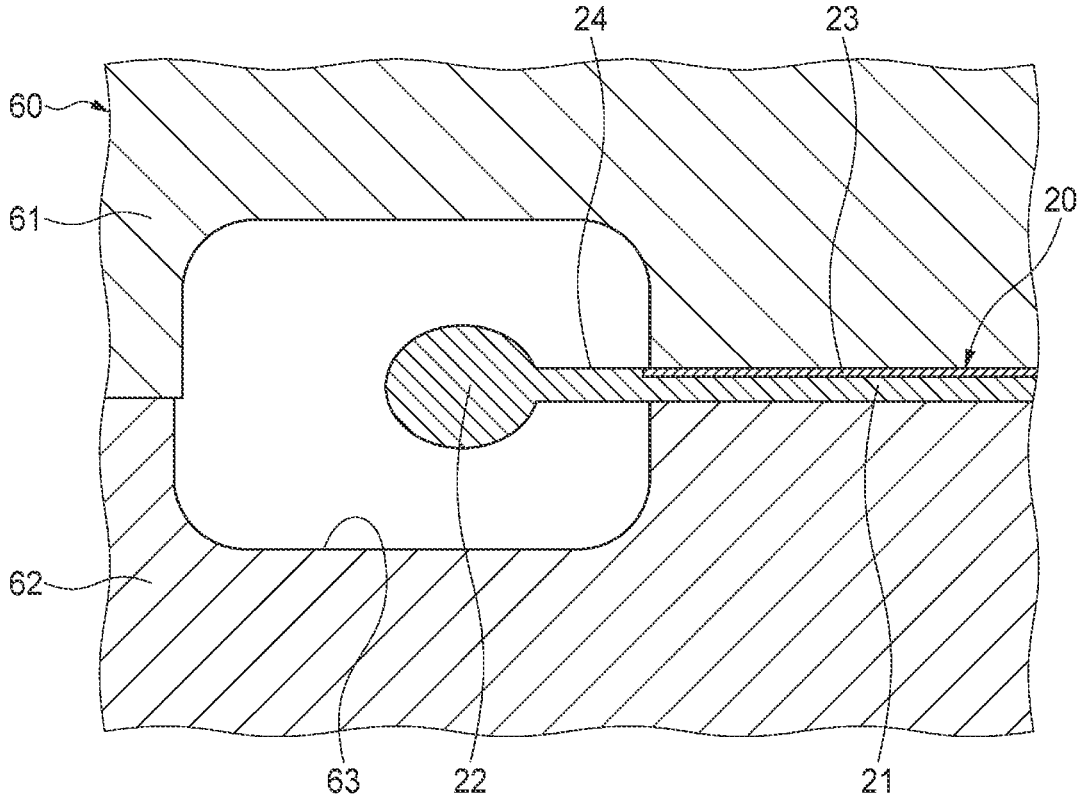
FIG. 15 is an exploded perspective view depicting a fastener tape which is disposed inside a mold.

In addition, as the method of injection-molding the fastener elements 31 (51) in step S2 of FIG. 13, the fastener elements 31 (51) are formed on the fastener tapes 20 by disposing the fastener tapes 20 so as to be pinched between an upper mold 61 and a lower mold 62 of a mold 60, and then injecting molten resin into a molding space 63 defined between the upper mold 61 and the lower mold 62, as shown in FIG. 14 and FIG. 15. In the meantime, the liquid-tight layers 23 are inserted and crushed between the upper mold 61 and the lower mold 62, thereby becoming substantially flush with the tape member 21, as shown in FIG. 8.

The liquid-tight slide fastener 10 is used in mountain clothes, winter clothes such as skiwear and coats, bags, or the like. The liquid-tight slide fastener 10 is attached to a base material for the clothes or bags such that the liquid-tight layers 23 are exposed to the outside. Therefore, the portion that is positioned in the reverse side of the base material may be configured so as not to form the liquid-tight layers 23.

DESCRIPTION OF REFERENCE NUMERALS

10 liquid-tight slide fastener
20 fastener tape
21 tape member
22 core section
23 liquid-tight layer
23*a* edge
24 tape-exposing section
30, 50 fastener element row
31, 51 fastener element
32A obverse side section
32B reverse side section
33 first base section
34 first head section
40 slider
43 flange
A1 area
A2 area

The invention claimed is:

1. A liquid-tight slide fastener comprising:

a pair of fastener tapes comprising a pair of woven or knitted tape members, core sections respectively provided on opposing tape edges of the pair of tape members, the core sections being expanded from the tape members, and liquid-tight layers respectively formed on one side of the pair of tape members;

a pair of fastener element rows respectively provided on the pair of fastener tapes, and comprised of a plurality of fastener elements; and a slider which causes the pair of fastener element rows to engage with and disengage from each other, wherein the liquid-tight layers are formed with gaps to the core sections in a width direction of the fastener tapes such that tape-exposing sections in which the tape members are exposed are formed in a range between the core sections and the liquid-tight layers, wherein each of the fastener elements has a pair of base sections attached to a respective core section of the pair of tape members, and wherein the liquid-tight layers are in contact with at least one of the base sections of the respective pair of base sections, and disposed between one of the pair of base sections and a respective tape member.

2. A liquid-tight slide fastener, comprising:

a pair of fastener tapes comprising a pair of woven or knitted tape members, core sections respectively provided on opposing tape edges of the pair of tape members, the core sections being expanded from the tape members, and liquid-tight layers respectively formed on one side of the pair of tape members;

a pair of fastener element rows respectively provided on the pair of fastener tapes, and comprised of a plurality of fastener elements; and a slider which causes the pair of fastener element rows to engage with and disengage from each other, wherein the liquid-tight layers are formed with gaps to the core sections in a width direction of the fastener tapes such that tape-exposing sections in which the tape members are exposed are formed in a range between the core sections and the liquid-tight layers, wherein the fastener elements are attached to the core sections, and wherein water repellent or oil repellent is attached to the tape members, the core sections, the liquid-tight layers, and the fastener elements.

3. The liquid-tight slide fastener according to claim 1, wherein in a side of the respective tape members at which the respective liquid-tight layers are formed, an area of a portion of the respective base sections, that is formed above the respective tape members in a range between the respective core sections and the respective liquid-tight layers is greater than an area of a portion of the respective base sections, that is formed above the respective liquid-tight layers.

4. The liquid-tight slide fastener according to claim 1, wherein respective edges of the respective liquid-tight layers at a side of the respective core sections are formed toward the respective core sections beyond respective outer ends of flanges of the slider in a width direction thereof.

* * * * *

UNITED STATES PATENT AND TRADEMARK OFFICE

CERTIFICATE OF CORRECTION

PATENT NO. : 9,015,908 B2
APPLICATION NO. : 13/512504
DATED : April 28, 2015
INVENTOR(S) : Satoshi Matsumoto et al.

It is certified that error appears in the above-identified patent and that said Letters Patent is hereby corrected as shown below:

In the Drawings:

On sheet 11 of 12, Figure 13, Reference Numeral S4, line 1, delete "ATTACHTOP" and insert -- ATTACH TOP --, therefor.

Signed and Sealed this
Fifteenth Day of September, 2015

Michelle K. Lee

Michelle K. Lee
*Director of the United States Patent and Trademark Office*